US005697534A

United States Patent [19]

Huyghe

[11] Patent Number: 5,697,534

[45] Date of Patent: Dec. 16, 1997

[54] COMPLIANT NOZZLE ASSEMBLY

[75] Inventor: Gerard Huyghe, Avoca, Mich.

[73] Assignee: TRI-Tool Boring Machine Company, Chesterfield Township Macomb County, Mich.

[21] Appl. No.: 673,156

[22] Filed: Jun. 25, 1996

[51] Int. Cl.[6] ..... B05C 5/00

[52] U.S. Cl. ..... 222/533; 222/527; 901/43; 901/49; 239/587.4; 239/588

[58] Field of Search ..... 222/526, 527, 222/533; 239/587.4, 587.5, 588, 169, 175; 901/41, 43, 49

[56] References Cited

U.S. PATENT DOCUMENTS

| | | | |
|---|---|---|---|
| 75,937 | 3/1868 | Longton | 222/533 |
| 476,966 | 6/1892 | Spencer | 239/587.5 |
| 1,597,477 | 8/1926 | Panhorst | 239/587.4 |
| 1,705,443 | 3/1929 | Edelman | 222/533 |
| 2,191,077 | 2/1940 | Kehl | 239/588 |
| 2,204,756 | 6/1940 | Hasse et al. | 239/587.5 |
| 3,206,084 | 9/1965 | Reid et al. | 222/533 |
| 3,224,793 | 12/1965 | Benjamin | 239/587.4 |
| 3,940,072 | 2/1976 | Ishikawa et al. | 239/587.5 |
| 4,273,289 | 6/1981 | Jette | 239/587.4 |
| 4,514,616 | 4/1985 | Warner | 901/49 |
| 4,563,788 | 1/1986 | Kobayashi | 239/588 |
| 4,697,742 | 10/1987 | Schnipke | 239/587 |
| 4,951,849 | 8/1990 | Townsend et al. | 901/43 |
| 4,969,604 | 11/1990 | Smith | 239/588 |
| 5,194,791 | 3/1993 | Cull | 901/49 |
| 5,361,881 | 11/1994 | Simond | 901/49 |
| 5,377,913 | 1/1995 | Van Der Woude | 239/588 |

FOREIGN PATENT DOCUMENTS

| | | | |
|---|---|---|---|
| 701709 | 3/1931 | France | 239/587.4 |

OTHER PUBLICATIONS

"Pro–Flo (TM) System" brochure of Nordson Corporation, Amherst, OH 44001, dated 1995.

"Automatic Dispensing Modules" brochure of Nordson Corporation, Amherst, OH 44001, dated 1995.

*Primary Examiner*—J. Casimer Jacyna

*Attorney, Agent, or Firm*—Peter D. Keefe

[57] ABSTRACT

A compliant nozzle assembly for being mounted with respect to an extrusion module of an extrusion apparatus, wherein the nozzle thereof compliantly yields when forceably encountering a workpiece. A nozzle having a hemispheric base is biased against a seal washer of an adapter member so as to be pivotably sealed therewith. A locator bearing has an annular bearing bevel which is biasably seated into an annular seat bevel of the adapter member. When the nozzle forcefully strikes a workpiece such that the nozzle is caused to be pivoted at the seal bearing, the annular bearing bevel will become unseated from its normally seated position in the annular seat bevel. This displacement results in the locator bearing traveling axially along the nozzle toward its tip, having the effect of causing the annular bearing bevel to the returned to its normally seated position in the annular seat bevel. Thus, the nozzle is able to compliantly move in response to forceful contact with a workpiece, yet will resiliently return to its preset location as soon as the forceful contact is terminated.

16 Claims, 2 Drawing Sheets

COMPLIANT NOZZLE ASSEMBLY

BACKGROUND OF THE INVENTION

1. Field of the Invention

The present invention relates to fluid delivery nozzles, and more particularly to nozzles used for the application of sealants and other fluids in industrial settings. More particularly, the present invention relates to a compliant nozzle assembly for facilitating robotic controlled fluid applications during automotive manufacturing.

2. Description of the Prior Art

Fluids, particularly high viscous fluids such as plastisols, greases, mastics, epoxies, silicones and urethanes are used for adhesives, sealers, fillers, etc. in association with manufacturing assembly operations. Typically, in high production assembly operations these high viscous fluids are extruded automatically via robotic control. In this regard, a typical industrial fluid extrusion apparatus includes: a robotic control system; a dispensing tank, such as a 55 gallon drum; an extrusion module connected with a robot arm of the robotic control system; a nozzle threadably fitted to the extrusion nozzle; and a pumping system for transferring fluid from the tank to the extrusion module under control of the robotic control system.

An example of operation of a typical fluid dispensing apparatus in an automotive assembly environment will now be recounted. Car bodies are composed of sections of formed sheet materials. At the seam formed along the conjunction of the sections a high viscous fluid is applied, such as a sealer or filler to provide a smooth and sealed seam-line. During the process of applying the high viscous fluid, the robotic control system locates the nozzle an optimum distance from the seam, follows the seam and extrudes an optimum amount of the high viscous fluid to the seam out of the top of the nozzle.

While the above described high viscous fluid dispensing methodology is dependable and reliable, problematically the nozzle may forcefully contact the workpiece, causing damage to any or all of the nozzle, extrusion module, robotic arm or the workpiece itself. This situation may arise, for example, where the location of the seam with respect to the robotic arm is not within preset tolerance, or there is a surface defect of the workpiece (such as a burr) at or near the seam.

Conventional nozzles are threadingly secured in a fixed location relative to the extrusion module so that when the nozzle abuttingly encounters the workpiece there is a hard mechanical impact. It would be beneficial, therefore, if somehow the nozzle could be mounted to the extrusion module in such a way that the nozzle is able to deflect when it encounters a workpiece and yet is able to return to its original location after engagement with the workpiece.

SUMMARY OF THE INVENTION

The present invention is a compliant nozzle assembly for being mounted with respect to an extrusion module, wherein the nozzle thereof compliantly yields when encountering a workpiece in terms of being movable both axially and pivotally with respect to the extrusion module, and further wherein the nozzle is resiliently biased to re-locate itself to its preset location with respect to the extrusion module.

The compliant nozzle assembly according to the present invention is composed generally of a nozzle having a hemispheric base, an adapter member having a nut portion at one end for threadably connecting with an extrusion module and a nozzle seat portion at the opposite end for receiving therethrough the nozzle, a seal washer located at the nozzle seat portion, a locator bearing for locatably interfacing with the nozzle seat portion and for receiving therethrough the nozzle, and first and second biasing springs. The nozzle seat portion has an external, axially centered annular seat bevel; while the locator bearing has a complementary, axially centered annular bearing bevel. A spherically curved surface of the hemispheric base of the nozzle abuts the seal washer and the annular bearing bevel is seated into the annular seat bevel. The first biasing spring is located between a split washer located on the nozzle and a flat face of the locator bearing. The second biasing spring is located inside the adapter member between a flat surface of the hemispheric base and an extrusion module fitting to which the adapter member is threadably secured.

In operation, the first and second biasing springs serve to firmly and sealingly press the spherically curved surface of the hemispheric base abuttingly against the seal washer, whereby the nozzle is able to pivot with respect thereto without loosing the seal. The annular bearing bevel is firmly seated in the annular seat bevel by the first biasing spring in a direction axial with respect to the nozzle. Accordingly, if the nozzle forcefully strikes a workpiece such that the nozzle is caused to be pivoted at the seal bearing, the annular bearing bevel will become unseated from its normally seated position in the annular seat bevel. This displacement results in the flat surface of the locator bearing traveling axially along the nozzle toward its tip, with the consequent result that the first biasing spring becomes further compressed. The additional compression of the first biasing spring has the effect to cause the annular bearing bevel to the returned to its normally seated position in the annular seat bevel. Thus, the nozzle is able to compliantly move in response to contact with a workpiece, yet will resiliently return to its preset location as soon as the contact is terminated.

Accordingly, it is an object of the present invention to provide a compliant nozzle assembly for the delivery of fluids, wherein the nozzle thereof positionally yields when an object is struck, yet resiliently resumes its preset location thereafter.

These, and additional objects, advantages, features and benefits of the present invention will become apparent from the following specification.

DETAILED DESCRIPTION OF THE PREFERRED EMBODIMENT

Figure 1:
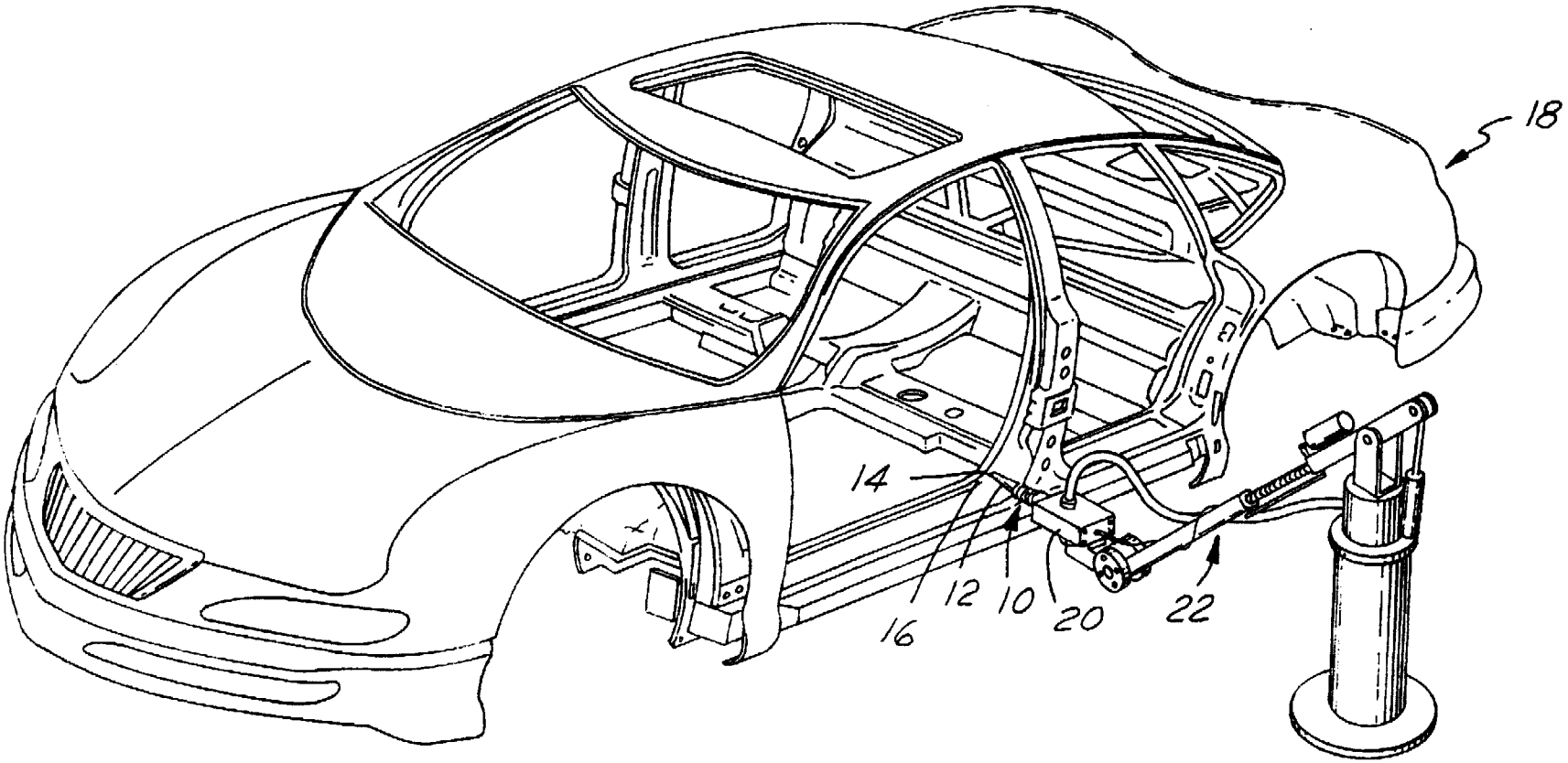
FIG. 1 is a perspective view of the compliant nozzle assembly shown in operation with respect to a robotically controlled extrusion module which forms a part of an automotive assembly operation.

Referring now to the Drawing, FIG. 1 shows an exemplary environment of use of the compliant nozzle assembly 10 according to the present invention. The compliant nozzle 10 includes a nozzle 12 having a tip 14 through which a fluid, typically a high viscous fluid, is extruded, such as to a seam 16 of a workpiece 18. The compliant nozzle assembly 10 is mounted to an extrusion module 20, which is, in turn, mounted to a robot arm 22 of a robotic control system. In this example, the tip 14 is maintained a predetermined optimal distance from the seam 16 and moved therealong as the robotic control system effects extrusion of a fluid at the tip via the extrusion module 20. In the event that the nozzle 12 forcefully strikes an unanticipated surface irregularity of the workpiece, the nozzle will compliantly yield, and then return to its preset location upon cessation of forceful contact of the nozzle with the workpiece.

Figure 2:
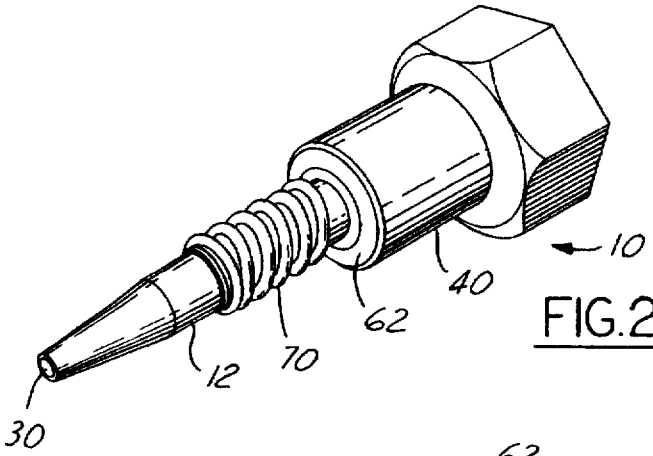
FIG. 2 is a perspective view of the compliant nozzle assembly according to the present invention.
Figure 3:
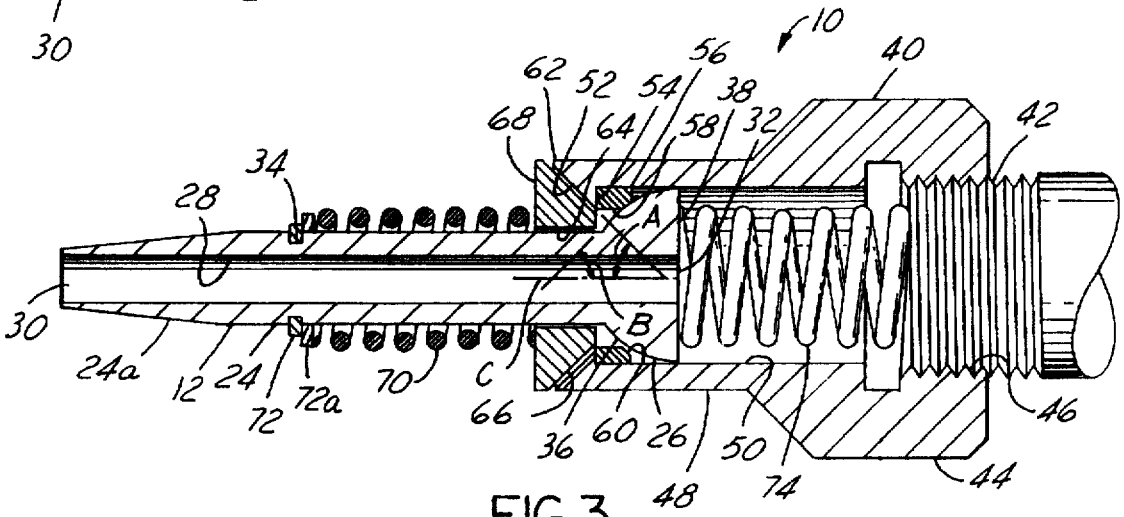
FIG. 3 is a partly sectional side view of the compliant nozzle assembly according to the present invention.
Figure 4:
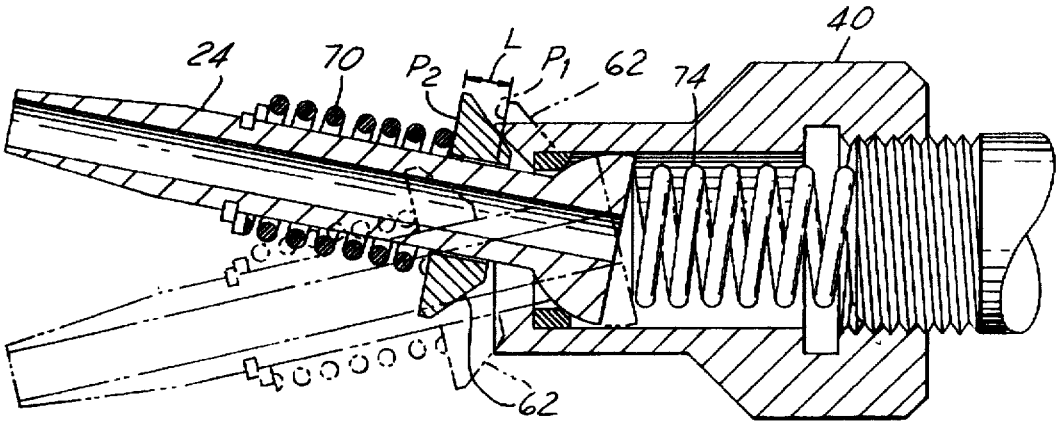
FIG. 4 is a partly sectional side view of the compliant nozzle assembly according to the present invention, wherein pivotable compliance of the nozzle thereof is depicted.

Referring now additionally to remaining FIGS. 2 through 4, the structure and function of the compliant nozzle assembly will be detailed with greater specificity.

The nozzle 12 is composed of a suitable material for extruding high viscous fluids, such as for example steel, preferably no. 6150L steel, the tip 14 being heat treated. The nozzle 12 includes an elongated nose 24 and an integrally connected hemispheric base 26. An axially located extrusion bore 28 extends entirely through the nozzle 12, wherein the extrusion bore terminates at the tip 14 in an extrusion orifice 30 and at the hemispheric base 26 in an infusion orifice 32. The elongated nose 24 may preferably include a nose taper **24*a* generally adjacent the tip 14. An annular slot 34 is provided in the exterior surface of the nose 24, preferably approximately about one-third the length of the nose as measured from the extrusion orifice 30. The hemispheric base 26 includes a spherically shaped surface 36 adjoining the nose 24 and an oppositely positioned flat surface 38 which is normally oriented transverse to the centerline axis defined by the extrusion bore 28**.

An adapter member 40 interfaces with the nozzle 12 for sealingly and compliantly securing the nozzle to a threaded fitting 42 of an extrusion module 20. The adapter member 40 includes a nut portion 44 at one end having a threaded bore 46 for threadably engaging the threaded fitting 42. The adapter member 40 further includes a nozzle seat portion 48 opposite the nut portion 44. The nozzle seat portion 48 has a through bore 50 which communicates with the threaded bore 46 to collectively form an adapter bore, wherein the diameter of the through bore is about the diameter of the flat surface 38 so that the hemispherical base 26 is receivable within the through bore. The adapter member 40 is preferably composed of steel, preferably no. 12L14 steel.

Opposite the nut portion 44, the nozzle seat portion 48 terminates at an annular seat bevel 52, wherein the angle A thereof is preferably forty-five degrees with respect to the centerline C of the through bore 50. An annular flange 54 is formed of the nozzle seat portion 48, which projects into the through bore 50 adjoining the seat bevel 52. A seal washer 56 composed preferably of DELRIN-AF material sealingly abuts the annular flange 54. The seal washer has a central aperture 58, and further a side thereof facing away from the annular flange 54 has an annular washer bevel 60, the angle of which being preferably forty-five degrees with respect to the centerline C of the through bore 50.

A locator bearing 62 is provided for locatably interfacing with the nozzle seat portion 48 and for receiving therethrough the nozzle 12. A preferred material for the locator bearing 62 is bronze, preferably AMPCO 18. The locator bearing 62 has a center opening 64 which is sized to receive the elongated nose 24 of the nozzle 12. The locator bearing 62 further has an annular bearing bevel 66 which is complementary to the annular seat bevel 52 (ie. having a bevel angle which is the same as that of the annular seat bevel, that is, also preferably forty-five degrees). Accordingly, the annular bearing bevel 66 seats with respect to the annular seat bevel 52 (see FIG. 3). Opposite the annular bearing bevel 66, the locator bearing 62 has a flat face 68.

The nozzle 12 is received, elongated nose 24 first, into the threaded and through bores 46, 50 of the adapter member 40 so that the elongated nose extends outwardly from the annular seat bevel 52 and the spherically curved surface 36 of the hemispheric base 26 abuts the annular washer bevel 60. The center opening 64 of the locator bearing 62 receives the elongated nose 24, wherein the annular seat bevel 52 seats into the annular bearing bevel 66.

A first biasing spring 70 slips over the elongated nose 24 and is compressingly trapped between a retainer washer 72 which is held in place by a slip ring **72*a* received in the annular slot 34, and the flat face 68 of the locator bearing 62. A second biasing spring 74 is located within the through bore 50, and abuts the flat surface 38 of the hemispheric base 26. When the threaded fitting 42 of the extrusion module 20 is threadably received into the threaded bore 46, the second biasing spring is compressed between the threaded fitting and the flat surface 38 of the hemispheric base 26. The first and second biasing springs 70, 74** are preferably composed of music wire.

It will be noted that an unobstructed, fluidically sealed passageway is provided by the compliant nozzle assembly 10 between the threaded fitting 42 of the extrusion module 20 and the extrusion orifice 30. It will also be noted that the first and second biasing springs 70, 74 cause the spherically curved surface 36 to sealingly abut the annular seal bevel 60, so that there is no leakage thereat. Accordingly, all fluid delivered from the extrusion module is extruded at the extrusion orifice 30.

FIG. 4 demonstrates the compliant nozzle assembly 10 in operation, such as for example with respect to the environment of use depicted in FIG. 1.

In the event an unanticipated surface irregularity forcefully contacts the nozzle 12 during extrusion of a fluid, the nozzle is able to compliantly pivot so that breakage or other damage is avoided. This pivoting occurs at the spherically curved surface 36 with respect to the annular seal bevel 60, wherein even though the nozzle may pivot, the sealing of the spherical surface at the annular bevel seat is continuously maintained (see the two depicted off-axial orientations of the nozzle shown in FIG. 4).

The nozzle automatically returns to its normal axial orientation as depicted in FIG. 3 from an off-axis orientation as depicted in FIG. 4 as soon as the nozzle no longer forcefully contacts the object. In the normal axial orientation of the nozzle 12, the planar surface 68 is located at a first position $P_1$ from the retainer washer 72. However, when the nozzle 12 is caused to pivot off-axis, the annular seat bevel 52 causes the annular bearing bevel 66 to unseat by sliding in relation thereto (see FIG. 4) whereby the planar surface 68 shifts to a second position $P_2$ which is closer to the retainer washer 72 by a distance L. As a result, the primary biasing spring 70 is compressed further (than its its normal compression when the nozzle is axially oriented and the annular bearing bevel is seated into the annular seat bevel). This additional compression of the first biasing spring 70 (while the compression of the second biasing spring 74 remains substantially constant) causes the annular bearing bevel to be returned to its normally seated placement on the annular seat bevel, with the consequent effect that the nozzle resumes its normal axial orientation as soon as the force causing pivoting of the nozzle (such as contact with an object) has ended.

It will be noted that the nozzle 12 will resiliently retract into the adapter member 40 in the event an impact requires this form of compliance with or without pivoting compliance.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A compliant nozzle assembly for extruding fluids, comprising:

a nozzle having a nose and a base, said base having a spherically curved surface adjoining said nose;

an adapter member having an adapter bore therethrough, said adapter member having an annular seat bevel formed at one end thereof;

seal means located adjacent said annular seat bevel for sealing said spherically shaped surface with respect to said adapter member when said spherically curved surface is biased thereagainst;

a locator bearing having a center opening, said locator bearing having an annular bearing bevel, said annular bearing bevel being complementary to said annular seat bevel, wherein said annular bearing bevel is seatable into said annular seat bevel; and biasing means for biasing said spherically shaped surface against said seal means and for biasing said annular bearing bevel seatingly into said annular seat bevel.

2. A compliant nozzle assembly for extruding fluids, comprising:

a nozzle having an extrusion bore therethrough, said nozzle having a nose, said extrusion bore terminating in an orifice at said nose, said nozzle having a base opposite said nose, said base having a spherically curved surface adjoining said nose;

an adapter member having an adapter bore therethrough, said adapter member having an annular seat bevel formed at one end thereof;

seal means located adjacent said annular seat bevel for sealing said spherically shaped surface with respect to said adapter member when said spherically curved surface is biased thereagainst;

a locator bearing having a center opening, said locator bearing having an annular bearing bevel, said annular bearing bevel being complementary to said annular seat bevel, wherein said annular bearing bevel is seatable into said annular seat bevel; and biasing means for biasing said spherically shaped surface against said seal means and for biasing said annular bearing bevel seatingly into said annular seat bevel.

3. The compliant nozzle assembly of claim 2, wherein said biasing means comprises:

a first biasing spring slipped over said nose; and abutment means located on said nose for compressing said first biasing spring between said abutment means and said locator bearing.

4. The compliant nozzle assembly of claim 3, wherein said biasing means further comprises second biasing spring means located in said adapter bore for at least in part biasing said spherically shaped surface against said seal means.

5. The compliant nozzle assembly of claim 3, wherein said seal means comprises a seal washer sealingly engaged with said adapter member adjacent said annular seat bevel.

6. The compliant nozzle assembly of claim 5, wherein said seal washer has a washer bevel which abuts said spherically shaped surface of said base.

7. The compliant nozzle assembly of claim 6, wherein said adapter bore has a centerline axis; further wherein said washer bevel has a bevel angle of substantially forty-five degrees with respect to said centerline axis.

8. The compliant nozzle assembly of claim 7, wherein said annular seat bevel has a bevel angle of substantially forty-five degrees with respect to said centerline axis.

9. The compliant nozzle assembly of claim 8, wherein said biasing means further comprises second biasing spring means located in said adapter bore for at least in part biasing said spherically shaped surface against said seal means.

10. The compliant nozzle assembly of claim 9, further comprising connection means for connecting said adapter member to a fluid extrusion apparatus.

11. The compliant nozzle assembly of claim 2, wherein said annular seat bevel has a bevel angle of substantially forty-five degrees with respect to said centerline axis.

12. A compliant nozzle assembly for extruding fluids from an extrusion apparatus, comprising:

a nozzle having an extrusion bore therethrough, said nozzle having a nose, said extrusion bore terminating in an orifice at said nose, said nozzle having a base opposite said nose, said base having a spherically curved surface adjoining said nose;

an adapter member having an adapter bore therethrough, said adapter member having an annular seat bevel formed at one end thereof;

seal means located adjacent said annular seat bevel for sealing said spherically shaped surface with respect to said adapter member when said spherically curved surface is biased thereagainst;

a locator bearing having a center opening, said locator bearing having an annular bearing bevel, said annular bearing bevel being complementary to said annular seat bevel, wherein said annular bearing bevel is seatable into said annular seat bevel;

first biasing means located at said nose for biasing said annular bearing bevel seatingly into said annular seat bevel and for at least in part biasing said spherically shaped surface against said seal means;

second biasing means located in said adapter bore for at least in part biasing said spherically shaped surface against said seal means; and connection means for connecting said adapter member to a fluid extrusion apparatus.

13. The compliant nozzle assembly of claim 12, wherein said seal means comprises a seal washer sealingly engaged with said adapter member adjacent said annular seat bevel.

14. The compliant nozzle assembly of claim 12, wherein said seal washer has a washer bevel which abuts said spherically shaped surface of said base.

15. The compliant nozzle assembly of claim 12, wherein said adapter bore has a centerline axis; further wherein said washer bevel has a bevel angle of substantially forty-five degrees with respect to said centerline axis.

16. The compliant nozzle assembly of claim 12, wherein said annular seat bevel has a bevel angle of substantially forty-five degrees with respect to said centerline axis.

* * * * *